United States Patent [19]

Long et al.

[11] Patent Number: 4,724,998

[45] Date of Patent: Feb. 16, 1988

[54] NEWSPAPER DELIVERY RECEPTACLE

[75] Inventors: Cliff A. Long, Yoakum; Ralph J. Ullman, Shiner, both of Tex.

[73] Assignee: Kasper Wire Works, Inc., Shiner, Tex.

[21] Appl. No.: 42,154

[22] Filed: Apr. 24, 1987

[51] Int. Cl.[4] ..... B65D 91/00

[52] U.S. Cl. ..... 232/1 C; 232/39; 248/222.1

[58] Field of Search ..... 232/1 C, 17, 38, 39; 248/224.3, 222.1, 225.1, 551

[56] References Cited

U.S. PATENT DOCUMENTS 2,471,839 5/1949 Schumacher ..... 248/222.1

3,514,064 5/1970 Katz ..... 248/551 X

*Primary Examiner*—Robert W. Gibson, Jr.

*Attorney, Agent, or Firm*—Gunn, Lee & Jackson

[57] ABSTRACT

A newspaper delivery receptacle to receive newspapers. The tube is securely attached to its support bracket by a wedge which may be inserted without tools. The support bracket is easily and securely mountable on either side of a support post. The tube opening is reinforced for long life.

15 Claims, 5 Drawing Figures

NEWSPAPER DELIVERY RECEPTACLE

BACKGROUND OF THE INVENTION

Currently available newspaper delivery tubes or receptacles comprise a generally rectangular or a cylindrical tube joined to a bracket or support means for mounting to a vertical support post.

U.S. Pat. No. 3,556,393 (Fibus 1971) discloses a newspaper delivery tube with guide members on the bottom surface of the tube for positioning and locating projecting peg members of the securing means or bracket. The pegs engage apertures in the bracket to secure it to the tube. Bolt-receiving openings in the tube and in the L-shaped support bracket receive therethrough bolts to additionally secure the tube to bracket. Side guides slide over the bracket to prevent movement of the tube on the bracket and permit a single bolt to affix the tube to the bracket. Fibus also discloses drainage holes in the bottom of the tube to allow water to drain therethrough and ribbed rails which will hold a newspaper off the bottom of the tube.

U.S. Pat. No. 3,134,538 (Fibus 1964) discloses a delivery tube with a bottom configuration which elevates a newspaper above the bottom of the tube and provides drainage to prevent water from damaging the newspaper. In addition, this device features a transparent rear window portion to allow the householder to determine whether or not the paper has been delivered. This tube also includes a slot along the top side for the delivery boy to insert a payment envelope.

U.S. Pat. No. 4,120,446 (Fuemmeler 1978) discloses a generally rectangular tube mounted to a bracket by means of a snap fastener and slide arrangement along the bottom of the tube and the top of the bracket. A pair of parallel guides along the bottom of the tube engage a matching pair of parallel rails along the outside edge of the bracket. This allows the tube to slide onto the bracket. The tube is prevented from sliding out of proper alignment by a snap fastener comprised of a boss on the lower surface of the tube which fits tightly within a corresponding opening on the upper surface of the bracket or vice versa.

Steel City Corporation of Youngstown, Ohio manufactures a newspaper delivery tube having drainage holes, rails, and paper anchors to hold papers in place. A galvanized steel bracket permits one bolt installation. A rolled bead at the tube opening reinforces the tube opening of the tube to the bracket.

Many thousands of these types of devices are installed every year. A commercial need and opportunity has long existed for the design of a newspaper delivery tube and bracket which offers improvements over the prior art.

SUMMARY OF THE INVENTION

The subject of this invention is a newspaper delivery tube. The invention provides an efficient means for attaching the tube of the delivery tube to its supporting bracket without tools, preventing articles from sliding out of the tube, and better means of reinforcing the front of the tube are improvements which will make the instant invention more useful than current devices. The tube is securely attached to its support bracket by a wedge which may be inserted without tools. The support bracket is easily and securely mountable on either side of a support post. The tube opening is reinforced for long life.

An object of this invention is an improved means for mounting a newspaper delivery tube on a bracket attached to a post which eliminates the need to use bolts to secure the receptacle to the bracket, permits quick and easy fastening of the tube to the bracket without the use of tools, and uses the surface of the bracket itself and a wedge means as fastener elements.

A further object of the invention is to provide a newspaper tube that will protect a newspaper placed inside from condensation, rain, snow, wind, or other weather conditions and at the same time provide an attractive appearance.

A further object of the invention is to provide a newspaper delivery tube with a bottom surface configuration which elevates the newspaper above the bottom and provides drainage from the tube.

A further object of the invention is to provide a newspaper delivery tube formed by a single molding operation of a suitable synthetic resin or plastic material which will withstand extremes of weather, which will not require repainting or redecorating, and which has long life expectancy.

With the foregoing and other objects in view, which will appear as the description proceeds, the invention resides in a combination and arrangement of parts and in the details of construction hereinafter described and claimed. It is patentee's intention that this patent cover all changes and modifications obvious to one of ordinary skill in the art.

DESCRIPTION OF THE PREFERRED EMBODIMENT

Figure 1:
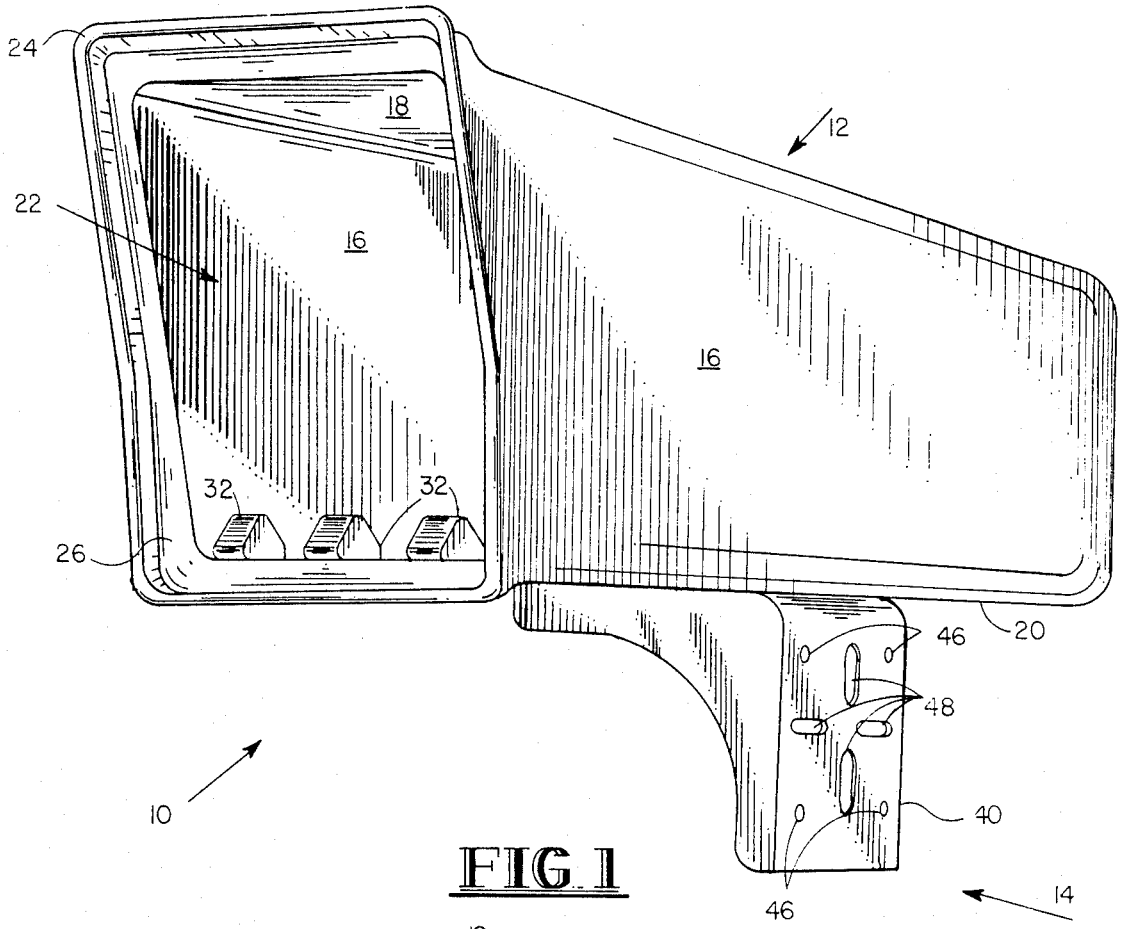
FIG. 1 shows a perspective view of the newspaper delivery tube.

FIG. 1 shows newspaper delivery receptacle 10 and its two major components, tube 12 and bracket 14. Tube 12 is comprised of two generally parallel side walls 16 connected at their upper edge to top 18 and connected at their lower edge to bottom 20. Tube 12 is open at front opening 22 to receive the newspaper therein. Tube 12 is sealed at rear wall 28 (see FIG. 3). The generally rectangular shape of tube 12 is also illustrated in FIG. 1. This shape approximates that of a folded newspaper.

Side walls 16, top 18 and bottom 20 are about 0.1 inch thick and extend about 17.3 inches from rear wall 28 to flange 26. Their junction with rear wall 28 is accomplished by their curving inward over about 1 inch to an about 4.26 inch square rear wall 28. Top 18 angles upward at about a 3° angle until meeting flange 26. Sides 16 angle outward at about 2° unitl meeting flange 26. Flange 26 and tube 12 are slanted at about a 15° angle for the majority of their union to position the top of flange 26 about 1.5 inches forward of its bottom. This helps shield the inside of tube 12 from the weather.

The perimeter of front opening 22 is comprised of outwardly canting flange 26, lip support 25, and outwardly canting lip 24. Flange 26 is a continuation of top 18, side walls 16 and bottom 20 beginning where they flare outwardly at front opening 22. Lip support 25 is a thick, flat continuation of flange 26 beginning where flange 26 breaks to a sharper flare. Lip 24 is a rounded bead on the front edge of lip support 25. Flange 26 is thicker and has a larger annulus than tube 12. Lip support 25 and lip 24 are thicker and have a larger annulus than flange 26. Flange 26 preferably has a longitudinal length of about 1 inch and a curved outer surface length of about 1.25 inches. Lip support 25 is preferably about 0.25 inches long and 0.25 inches thick. Lip 24 is about 0.45 inches in diameter. The angle of lip 24 changes from about 15° to about 0° about 2.5 inches from the bottom of lip 24.

The space within the opening of lip 24 is about 8.8 inches wide measured from the inner edge of each side and about 8.4 inches tall measured from the inner edges of the front top and bottom of lip 24.

This reinforcing of tube 12 at front opening 22 serves important functions.

Firstly, while rear wall 28 braces the rear end of tube 12, front opening 22 is not similarly braced. The greater thickness of flange 26 and lip 24 offer additional lateral and vertical support to prevent deformation of tube 12. Further, however, joining these three elements of different inner and outer dimensions, tube 12, flange 26 and lip 24, provides inherent structural resistance to lateral or vertical deformation of tube 12 as the geometry of the structure insures that they each serve to brace each other against such pressures. The structural effect is similar to providing an encircling brace with a thickness equal to the difference between the smallest diameter for the inner annulus of tube 12 and the largest diameter for the outer surface of lip 24.

Secondly, the wide inner diameter of lip 24 which narrows at flange 26 and narrows further at tube 12 acts as a funnel to facilitate delivery of newspapers to within tube 12. This is important as newspapers are delivered by persons on bicycles or in automobiles who are attempting to deliver the papers as quickly as possible and who can be quite careless in delivering the papers.

Thirdly, the geometry of this combination, lip 24, flange 26 and tube 12, having different diameters, reinforces lip 24 against the battering it will inevitably receive over the years as hundreds of newspapers are thrown at receptacle 10. The extra thickness of lip 24 and its being rounded also helps in this respect.

Figure 2:
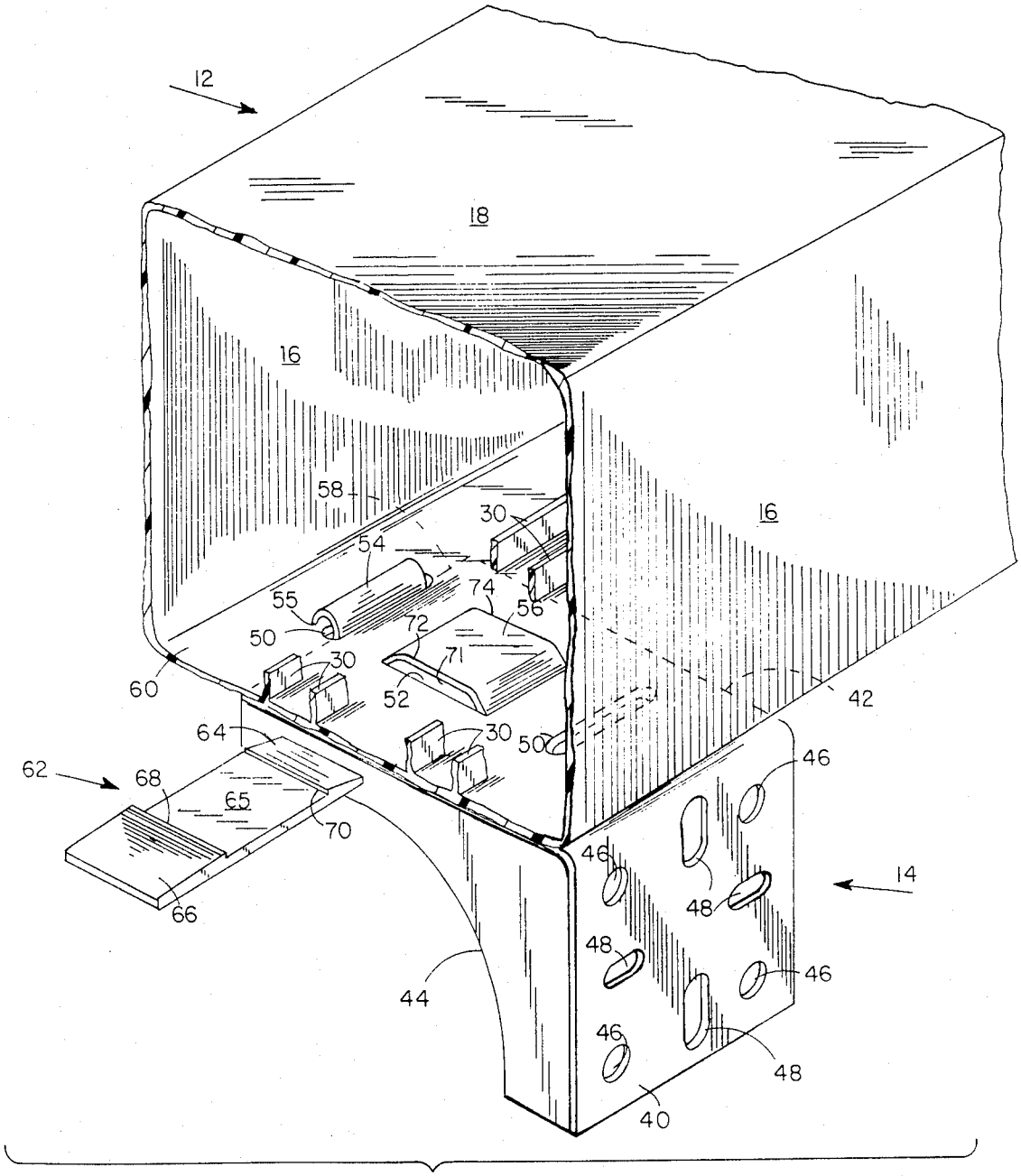
FIG. 2 shows a sectional view through section 1—1 illustrating the mounting features of the invention.

FIG. 2 shows bracket 14 and its attachment to tube 12. When properly attached, bracket 14 lays flush along bottom 20 of tube 12. Bracket 14 consists of vertical side 40 attached to horizontal side 42. Vertical side 40 and horizontal side 42 are at right angles to each other and are braced by support rib 44. The weight of the newspaper in tube 12 is transferred to horizontal side 42 and, through support rib 44, to vertical side 40. Vertical side 40 is attached to a conventional support post (not shown) by conventional fastener means such as bolts through bolt holes 46 or fastener grooves 48. The combination of the bolt holes 46 and fastener grooves 48 as shown permits bracket 14 to be adapted to a wide variety of preexisting support posts and fasteners.

Bottom 20 contains two hook slots 50 with a center opening 52 which overlay horizontal side 42 of bracket 14. Horizontal side 42 of bracket 14 has hook 54. Hook 54 is a curved sheet-like hook which projects vertically upward from outer edge 58 of horizontal side 42 and then curls downward and away from outer edge 58 to an edge denoted as hook lip 55. Hook 54 and hook lip 55 are sized to allow them to slide into hook slot 50. It can be seen in FIG. 2 that the distance between the outer edge of hook lip 55 and the outer edge of hook 54's attachment to upper face 42 (its width) is greater than the width of hook slots 50. Hook lip 55, in its undisturbed state, is positioned approximately level to upper face 42. As bottom 20 necessarily has a thickness greater than zero, bottom 20 can not lie flush with upper face 42 unless hook 54 is inserted within hook slot 50 and tube 12 is forcibly rotated along a longitudinal axis at hook slot 50 upon hook 54. When tube 12 is fully rotated to lie flush with bracket 14, hook lip 55 is in contact with top surface 60 of bottom 20 and exerts downward pressure on bottom 20.

Horizontal side 42 of bracket 14 also contains raised eye 56. Raised eye 56 is located on horizontal side 42 to protrude through center opening 52 when tube 12 is rotated upon hook 54 as described above to provide eye opening 71 between top surface 60 of bottom 20 and the inside of raised eye 56.

Wedge 62 as seen in FIG. 2 is generally rectangular with a wedge-shaped thick end 66, a flat center portion 65 and a wedge-shaped thin end 64. Wedge 62 is preferably constructed of a durable, resilient, flexible material such as hard rubber or plastic. Thick end lip 68 and thin end lip 70 are sloped shoulders bordering flat, center portion 65 as shown.

Wedge 62 is inserted, thin end 64 first, into eye opening 71 until thick end lip 68 abuts front edge 72 of raised eye 56. When this occurs, thin end 64 of wedge 62 will have completely passed beyond rear edge 74 of raised eye 56. Wedge 62 secures tube 12 to bracket 14 by preventing the rotational force of distended hook 54 acting upon bottom 20 from rotating tube 12 off of bracket 14. Lips 68 and 70 prevent wedge 62 from sliding out of raised eye 56. Thus, tube 12 is secured to bracket 14 at two contact interfaces, hook lip 55 acting upon bottom 20 and raised eye 56 acting through wedge 62 upon bottom 20. Both contact interfaces serve to press a large section of bottom 20 of tube 12 against the full horizontal side 42 of bracket 14.

Figure 3:
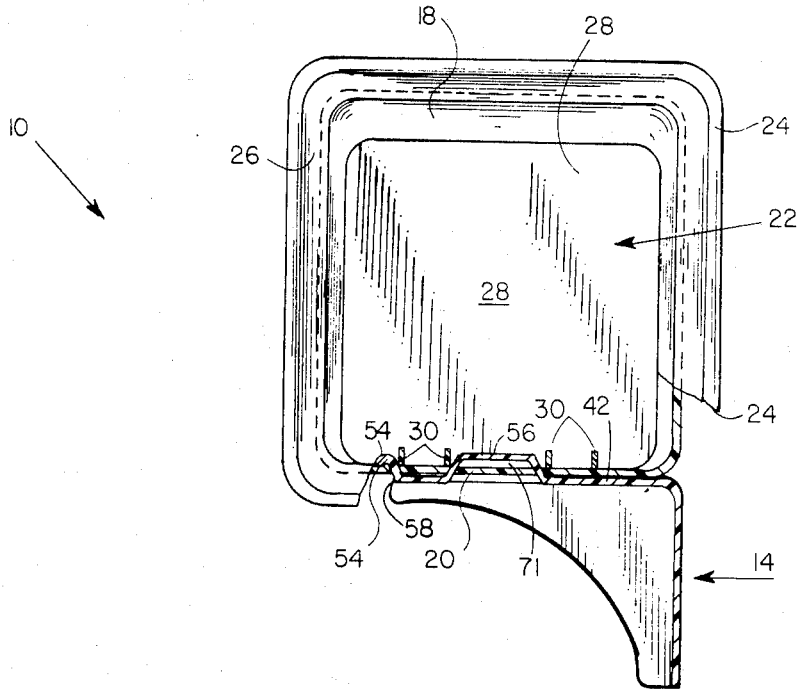
FIG. 3 shows a front view of the invention with a portion cut away to show features of the securing means.

FIG. 3 shows lip 24 and flange 26 cut away to illustrate how raised eye 56 extends through center opening 52 above top surface 60. After tube 12 is rotated to lay flush on horizontal side 42 as discussed above, eye opening 71 is sufficient to slide wedge 62 therein and hold tube 12 to bracket 14. FIG. 3 also illustrates the necessity of rotating tube 12 in order to insert hook lip 55 in hook slots 50. It can be seen in FIG. 3 that tube 12 must be held at an angle to horizontal side 42 when fixing it in hook 54 and hook lip 55 through hook slot 50.

Wedge 62 is about 4 inches long, about 1.3 inches wide, about 0.25 inches thick in its center portion, about a 0.25 inch lip between the center the thick end, about a 0.1 inch lip between the center and the thin end and tapers to about 0.25 inches at either end. Center opening 52 is about 1.67 inches wide and about 1.67 inches long. Slots 50 are about 0.2 inches wide and about 2.2 inches long. Eye extends about 0.35 inches from horizontal side 42 to the upper face of eye and about 0.25 inches from horizontal side 42 to the lower face of eye 56 and is slopped on each side from a distance between lower bottom edge of the eye of 1.6 inches to a distance between the upper outer edges of the eye of about 1.45 inches. This slight slope facilitates insertion of eye 56 into center opening 42. [horizontal side is 42] Hook edge 58 ends about 1.2 inches above the upper face of bottom and about 0.25 inches from the edge of bottom and is sized to fit easily within slot 50.

Figures 4, 5:
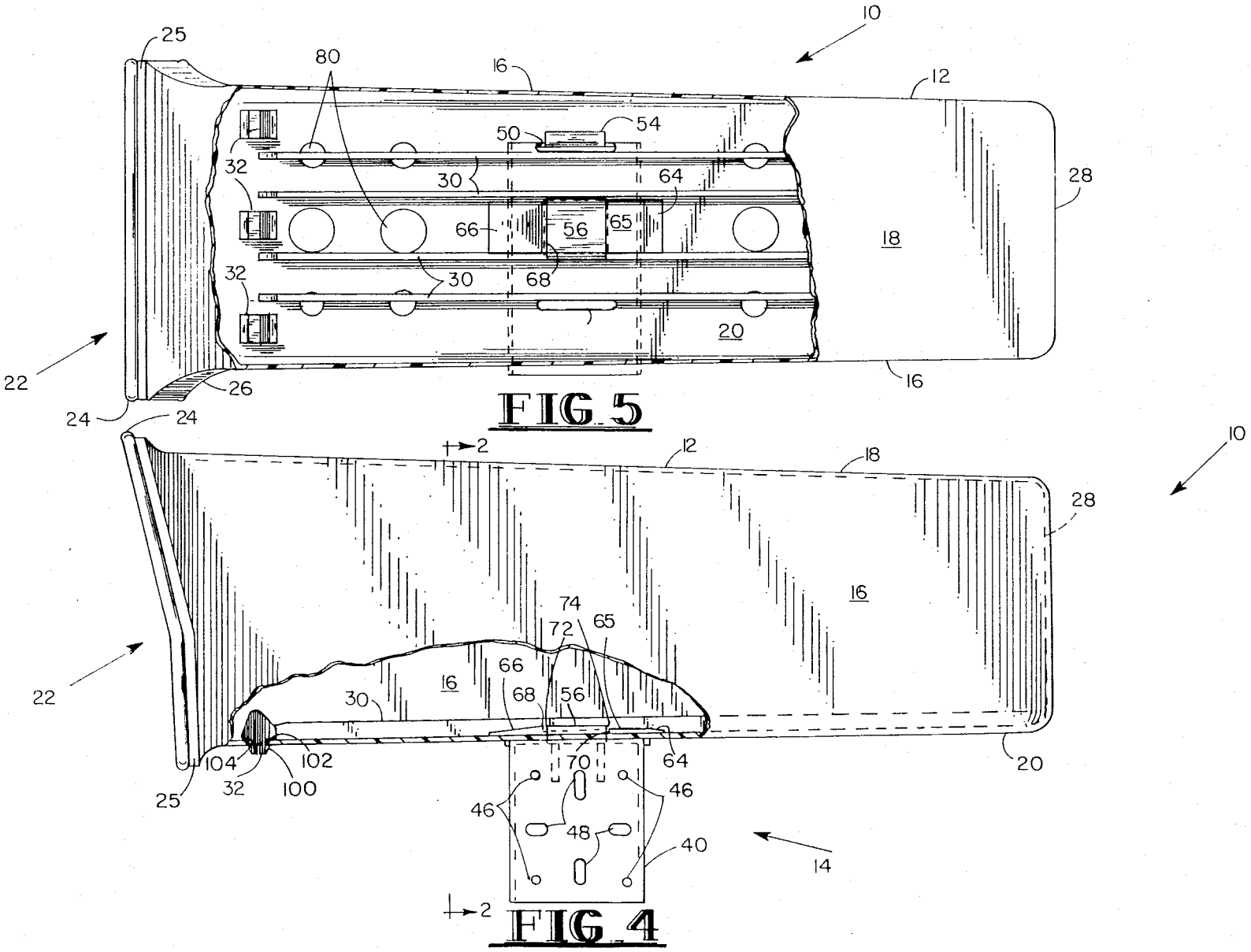
FIG. 4 shows a side view of the invention with a portion cut away to show features of the securing means and with certain inner members shown in relief.
FIG. 5 shows an elevated view with a portion cut away to show features of the securing means and the bottom of the receptacle.

FIG. 4 shows wedge 62 fitted snugly within raised eye 56. Lip 68 abuts front edge 72 of raised eye 56 and thin end 64 just clears rear edge 74 of raised eye 56. Lips 68 and 70 lock wedge 62 in place. Wedge 62 can be removed by depressing lip 70 beneath rear edge 74 of raised eye 56 and then sliding wedge 62 out from under raised eye 56. This permits the consumer, any homeowner, to quickly and easily secure or remove tube 12 from bracket 14 without using any tools.

FIG. 5 shows the relationship of tube 12 to bracket 14 and wedge 62 when tube 12 is securely affixed to bracket 14. The hook slots 50, one on each side of raised eye 56, permit tube 12 to be reversed on bracket 14. When this is done, hook 54 is inserted in the opposite hook slot 50.

To remove tube 12 from bracket 14, thin end lip 70 can be depressed and wedge 62 be removed by and pulling thick end 66 of wedge 62. This will slide wedge 62 out of raised eye 56 and permit tube 12 to be removed after rotation about hook 54.

FIG. 2 shows features found on bottom 20 of tube 12. These features include at least four rails 30 to support the paper above bottom 20. Precipitation and condensation can cause water to accumulate along bottom 20. Rails 30 keep the paper dry by projecting vertically upward, preferably about 0.4 inches from bottom 20, to prevent the newspaper from laying in water accumulated on bottom 20. Rails 30 are integrally molded together with tube 12. The front edges of rails 30 are sloped to facilitate entry of newspapers and prevent the customer from scratching his hand on a sharp edge.

Placement of rails 30 as shown in FIG. 5 is not uniform, there being a larger distance between center rails 30 than between the pairs of outside rails. This spacing permits use of center opening 52 and raised eye 56 as shown in FIG. 5. Further, outer rails 30 are placed sufficiently close to the center of tube 12 to permit slots 50 to be positioned to their outside and thus permit hook 54 to be usefully fitted through slots 50. The inner rails 30 are about 1.6 inches apart and the outer rails 30 are 0.85 inches to the outside of inner rails 30. The rails are at least about 0.4 inches high and about 0.1 inches thick.

Also illustrated in FIG. 5 are ventilation apertures 80 for draining fluids that collect on bottom 20 through rain, sleet, snow, etc. In addition, ventilation apertures 80 in combination with rails 30 provide air circulation that helps prevent condensation within the tube and facilitate drying articles on rails 30. This is especially a problem with newspapers that come wrapped in thin plastic covers, as condensation collects thereon. Ventilation apertures 80 are designed to mitigate this.

At least four rails 30 sized and placed as disclosed, are required to insure that items placed in tube 12 do not contact water on bottom 20. This is because many of the items put into tube 12 may be newspapers, envelopes, flyers, etc. which are extremely flexible and will sag. Without a sufficient number of rails of a sufficient height these articles will sag and contact water standing on the bottom surface. As water itself may bead the distance between the article to be protected and the water is less than the distance between that article and the upper face of bottom 20.

When a paper is thrown into tube 10, its rebound off rear wall 28 may tend to bounce the paper back out of front opening 22. Wedge-shaped paper anchors 32 prevent this. The paper anchors 32 project about 0.7 inches above bottom 20 and thus stand slightly above rails 30. This helps prevent the papers from bouncing out of tube 12. Using three paper anchors 32 placed as shown in FIG. 5 insures a paper sliding out of tube 12 will contact at least one of paper anchors 32.

Paper anchors 32 are preferably comprised of a hard rubber material to help catch a sliding paper, are sloped on their forward and rear sides to resist damage and prevent customers from scraping their hands and are secured within tube 12 by a sloping sleeve 100 and shoulder 102 inserted into paper anchor holder 104 as shown in FIG. 4. Use of insertable paper anchors 32 makes production of the invention more economical and permits their replacement if they become broken and allows for the use of a softer material for their construction than if they were an integral part of tube 12. Use of one piece sloped rubber or plastic inserts as shown is less expensive than the more complicated spring-loaded paper anchors shown in the prior art.

In the preferred embodiment, tube 12 is constructed of durable plastic or synthetic resin and may be formed in a single molding operation. In alternate embodiments, metal or other suitable materials may be used.

In the manner set forth above, tube 12 can be removably affixed to bracket 14 in a simple, rapid manner and without tools, creating a unique newspaper delivery receptacle 10.

Although the invention has been described with reference to a specific embodiment, this description is not meant to be construed in a limiting sense. Various modifications of the disclosed embodiments will become apparent to those skilled in the art upon reference to this description of the invention. It is, therefore, contemplated that the appended claims will cover such modifications that fall within the true scope and spirit of the invention.

I claim:

1. An improved newspaper delivery receptacle comprised of an elongated tube having a first side, a second side, a top and a bottom, all connected along their longitudinal edges, having a back wall at its back end, having a front opening at its front end and being secured by securing means to an attachment side of a support bracket, said support bracket being capable of being mounted on a support post, the improvement comprising:

a center opening and a first slot in said bottom;

a hook at an edge of said attachment side, said hook curving away from said attachment side and terminating at a lip near the plane of said attachment side, said hook sized to be capable of being inserted through said first slot;

an eye on the upper face of said attachment side, said eye being located and sized to be capable f protruding through said center opening sufficiently to expose an eye opening above said bottom when said hook is inserted within said first slot and said tube is rotated upon said hook toward said attachment;

a wedge sized and shaped to be capable of being securely fitted within said eye opening and to be capable of being removed from said eye opening without damaging the invention; wherein said wedge has a first part, a second part and a third part, said first part being sloped to facilitate insertion of said wedge into said eye opening, said second part being thinner than the inner end of said first part, said first part being a first wedge lip where it separated from said connects to said second part said third part being thicker at its inner end than said second part and being a second wedge lip where it connects to said second part, said first part being sized and shaped to permit said first part to be insertable through said eye opening, said second part being sized and shaped to fit within said eye opening and said first and second wedge lips being sized and shaped to permit said wedge to be secured within said eye opening without the use of tools and to be removed from said eye opening without the use of tools;

said tube and said bracket sized and shaped to permit said tube to be fixed upon said bracket by fitting said hook through said first slot, rotating said tube upon said hook toward said attachment side until said bottom abuts said attachment side and said eye projects sufficiently through said center opening to permit said wedge to be inserted within said eye opening; said combination being capable of removably securing said tube to said bracket at the interface between the upper surface of said bottom and said hook lip and at the interface between said wedge and said upper surface of said bottom, both said interfaces serving to secure the lower surface of said bottom against said attachment side;

said bottom contains a plurality of front slots near said front opening each slot being capable of securely receiving a paper anchor and further comprising paper anchors secured within said front slots, each said paper anchor being comprised of one piece, being sized to project high enough to prevent some papers from sliding out of said tube and being shaped to protect against a user of the invention injuring himself on said paper anchors if said user rubs a hand upon a said paper anchor; and said front opening is comprised of the front of said tube, a flange joined to said front of said tube, said flange canting outward from said tube and a lip joined to the front of said flange, said lip being thicker than said flange and having an outer diameter greater than said flange, said combination of said front of said tube, said flange and said lip providing greater structural resistance to lateral and vertical deformation of said tube and providing greater resistance to damage to the invention from impacts upon the front opening of the invention than without said flange and said lip.

2. An improved newspaper delivery receptacle comprised of an elongated tube having a first side, a second side, a top and a bottom, all connected along their longitudinal edges, having a back wall at its back end, having a front opening at its front end and being secured by securing means to an attachment side of a support bracket, said support bracket being capable of being mounted on a support post, the improvement comprising:

a center opening and a first slot in said bottom;

a hook at an edge of said attachment side, said hook curving away from said attachment side and terminating at a lip near the plane of said attachment side, said hook sized to be capable of being inserted through said first slot;

an eye on the upper face of said attachment side, said eye being located and sized to be capable of protruding through said center opening sufficiently to expose an eye opening above said bottom when said hook is inserted within said first slot and said tube is rotated upon said hook toward said attachment side;

a wedge sized and shaped to be capable of being securely fitted within said eye opening and to be capable of being removed from said eye opening without damaging the invention;

said tube and said bracket sized and shaped to permit said tube to be fixed upon said bracket by fitting said hook through said first slot, rotating said tube upon said hook toward said attachment side until said bottom abuts said attachment side and said eye projects sufficiently through said center opening to permit said wedge to be inserted within said eye opening; said combination being capable of removably securing said tube to said bracket at the interface between the upper surface of said bottom and said hook lip and at the interface between said wedge and said upper surface of said bottom, both said interfaces serving to secure the lower surface of said bottom against said attachment side.

3. The invention of claim 2 wherein said bottom contains a plurality of front slots near said front opening, each front slot being capable of securely receiving a paper anchor and further comprising paper anchors secured within said front slots, each said paper anchor being comprised of one piece, being sized to project high enough to prevent some papers from sliding out of said tube and being shaped to protect against a user of the invention injuring himself on said paper anchors if said user rubs a hand upon a said paper anchor.

4. The invention of claim 2 wherein said front opening is comprised of the front of said tube, a flange joined to said front of said tube, and a lip joined to the front of said flange, said flange canting outward from said tube and said lip being thicker than said flange and having an outer diameter greater than said flange, said combination of said front of said tube, said flange and said lip providing greater structural resistance to lateral and vertical deformation of said tube and providing greater resistance to damage to the invention from impacts upon the front opening of the invention and providing a larger frontal access area to said tube than without said flange and said lip.

5. The invention of claim 2 wherein said wedge has a first part connected to a second part and said second part connected to a third part, said first part being shaped to facilitate insertion of said wedge into said eye opening, said second part being thinner than the inner ends of said first part and third part, said first part having a first wedge lip where it connects to said second part, said third part having a third wedge lip where it connects to said second part, said first part being sized and shaped to permit said first part to be insertable through said eye opening, said second part being sized and shaped to fit within said eye opening and said first and second wedge lips being sized and shaped to permit said wedge to be secured within said eye opening without the use of tools and to be removed from said eye opening without the use of tools.

6. The invention of claim 2 wherein said bottom further comprises at least four rails located on the upper face of said bottom, each of said rails being at least about 0.4 inches high, for keeping articles placed within said receptacle from coming into contact with water which may be on said upper face of said bottom and for facilitating air circulation under said article located on said rails, all to maintain the dryness of said article and to permit said article to dry if said article is wet.

7. The invention of claim 6 wherein said bottom has ventilation holes for air to circulate from the outside of said receptacle through the spaces between all of said runners.

8. The improved newspaper delivery receptacle as described in claim 2 above wherein said tube is constructed of plastic and formed by injection molding.

9. The invention of claim 2 wherein said tube has two first slots, one on either side of said center opening for permitting said invention to be attahed to said support bracket facing either direction.

10. The invention of claim 3 wherein said front opening is comprised of the front of said tube, a flange joined to said front of said tube, and a lip joined to the front of said flange, said flange canting outward from said tube and said lip being thicker than said flange and having an outer diameter greater than said flange, said combination of said front of said tube, said flange and said lip providing greater structural resistance to lateral and vertical deformation of said tube and providing greater resistance to damage to the invention from impacts upon the front opening of the invention and providing a larger frontal access area to said tube than without said flange and said lip.

11. The invention of claim 10 wherein said wedge has a first part connected to a second part and said second part connected to a third part, said first part being shaped to facilitate insertion of said wedge into said eye opening, said second part being thinner than the inner ends of said first part and third part, said first part having a first wedge lip where it connects to said second part, said third part having a third wedge lip where it connects to said second part, said first part being sized and shaped to permit said first part to be insertable through said eye opening, said second part being sized and shaped to fit within said eye opening and said first and second wedge lips being sized and shaped to permit said wedge to be secured within said eye opening without the use of tools and to be removed from said eye opening without the use of tools.

12. The invention of claim 4 wherein said bottom contains a plurality of front slots near said front opening, each front slot being capable of securely receiving a paper anchor and further comprising paper anchors secured within said front slots, each said paper anchor being comprised of one piece, being sized to project high enough to prevent some papers from sliding out of said tube and being shaped to protect against a user of the invention injuring himself on said paper anchors if said user rubs a hand upon a said paper anchor.

13. The invention of claim 12 wherein said wedge has a first part connected to a second part and said second part connected to a third part, said first part being shaped to facilitate insertion of said wedge into said eye opening, said second part being thinner than the inner ends of said first part and third part, said first part having a first wedge lip where it connects to said second part, said third part having a third wedge lip where it connects to said second part, said first part being sized and shaped to permit said first part to be insertable through said eye opening, said second part being sized and shaped to fit within said eye opening and said first and second wedge lips being sized and shaped to permit said wedge to be secured within said eye opening without the use of tools and to be removed from said eye opening without the use of tools.

14. An improved newspaper delivery receptacle for receiving newspapers comprised of an elongated tube having a first and a second side, a top and a bottom, connected along their longitudinal edges, being closed at its back by a back wall, having a tube opening at its front end and secured by securing means to the top face of a support bracket mountable on a support post, the improvement comprising:

said tube, constructed of plastic and formed by injection molding containing a flange at said tube opening, wherein said flange contains a beaded lip thereon for reinforcement of said tube opening;

said securing means comprised of said bottom with ventilation apertures therethrough, said top face and a wedge, said bottom having a center opening, a first slot between said center opening and a longitudinal edge of said bottom and a second slot between said center opening and the other longitudinal edge of said bottom, said top face having a near edge near said support post when said delivery receptacle is mounted thereon and having a far edge far from said support post;

a hook and an eye, said hook located at said far edge and said eye located on said top face, said hook having a removed end terminating below a level of said top face, said eye being sized to protrude through said center opening sufficiently to expose said eye's opening above said bottom; and said wedge sized and shaped to securely fit within said exposed eye opening, said hook protruding through one of said slots, said eye protruding through said center opening and said wedge secured within said eye opening, said combination thereby removably securing said tube to said support bracket at two points, an interface between said bottom and said removed end of said hook and an interface between said wedge and said bottom, both to urge said bottom against said top face providing a removable securing means, which may be assembled and disassembled without tools;

a paper anchor, generally wedge-shaped, with a base fixedly attached to said bottom of said tube and located near said tube opening to keep newspapers therein; and at least two rails fixedly attached to said bottom of said tube and extending thereof to a position above said bottom, said rails for holding said newspaper above said bottom.

15. An improved newspaper delivery receptacle for recieving newspapers comprised of an elongated tube having upper, first, lower and second sides connected along their longitudinal sides, being closed at its back end by a back wall, having a tube opening at its front end secured by securing means to the upper face of a support bracket mountable via its lower face upon a support post, the improvement comprising:

said securing means comprised of said lower side, said upper face and a wedge, said lower side having a center opening, a first slot between said center opening and a longitudinal side of said lower side and a second slot between said center opening and the other longitudinal side of side lower side, said upper face having a near side near said lower face and a far side far from said lower face;

a hook and an eye, said hook located at said far side and said eye located upon said upper face, said hook having a far end terminating below the level of said upper face, said eye being sized to protrude through said central opening sufficiently to expose said eye's opening above said lower side and said wedge sized and shaped to securely fit within said exposed opening, said hook protruding through one of said slots, said eye protruding through said center opening and said wedge secured within said eye opening, said combination removably securing said tube to said support bracket at two points, the interface between said lower side and said end of said hook and the interface between said wedge and said lower side both to press said lower side against said upper face to provide a removable securing means, which may be assembled and disassembled without tools.

* * * * *